US006565327B2

(12) United States Patent
Yoo et al.

(10) Patent No.: US 6,565,327 B2
(45) Date of Patent: May 20, 2003

(54) CIRCUIT FOR DRIVING LINEAR COMPRESSOR

(75) Inventors: Jae Yoo Yoo, Gwangmyeung (KR); Jae Chun Lee, Seoul (KR); Min Kyu Hwang, Gwangmyung (KR); Chel Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/984,050

(22) Filed: Oct. 26, 2001

(65) Prior Publication Data

US 2002/0064461 A1 May 30, 2002

(30) Foreign Application Priority Data

Nov. 28, 2000 (KR) ..... 00-71299

(51) Int. Cl.[7] ..... F04B 49/06
(52) U.S. Cl. ..... 417/44.1; 417/44.11; 417/417
(58) Field of Search ..... 417/44.1, 45, 18, 417/44.11, 212, 417

(56) References Cited

U.S. PATENT DOCUMENTS 3,980,964 A * 9/1976 Grodinsky ..... 330/29
4,417,196 A * 11/1983 Cueto et al. ..... 323/210
4,658,120 A * 4/1987 Fujikawa ..... 219/505
5,032,772 A * 7/1991 Gully et al. ..... 318/135
5,590,013 A * 12/1996 Harasawa ..... 361/187
5,615,097 A * 3/1997 Cross ..... 363/84
6,014,325 A * 1/2000 Pecore ..... 363/126
6,351,181 B1 * 2/2002 Vittoz ..... 327/541

* cited by examiner

*Primary Examiner*—Charles G. Freay
*Assistant Examiner*—William H. Rodriguez
(74) *Attorney, Agent, or Firm*—Fleshner & Kim, LLP

(57) ABSTRACT

Disclosed is a circuit for driving a linear compressor enabling to reduce a cost in detecting voltage and current applied to a linear compressor by decreasing the number of precision resistors. The present invention includes a linear compressor controlling a cooling capacity by varying a stroke through an up-and-down straight-line motion of a piston, an electric circuit part supplying the linear compressor with voltage and current in accordance with a switching signal of an AC switching device through a current detect resistor and the AC switching device wherein a ground terminal is connected between the current detect resistor and linear compressor, a voltage detection unit detecting the voltage applied to the linear compressor by taking the ground terminal as a reference and outputting the detected voltage, a stroke calculation unit receiving the detected current and voltage to calculate the stroke, a speed or an acceleration speed of the linear compressor, and a micro-computer inputting a switching signal for controlling the voltage applied to the linear compressor into the switching device to make a present stroke follow an initial stroke reference.

21 Claims, 2 Drawing Sheets

CIRCUIT FOR DRIVING LINEAR COMPRESSOR

BACKGROUND OF THE INVENTION

1. Field of the Invention

The present invention relates to a circuit for driving a linear compressor enabling to reduce a cost in detecting voltage and current applied to a linear compressor by decreasing the number of precision resistors.

2. Background of the Related Art

Generally, a linear compressor having no crankshaft transforming a rotary motion into a straight-line motion enables to reduce its frictional loss, thereby being superior to other compressors in efficiency. And, the linear compressor variously transforms a voltage corresponding to a stroke applied to the linear compressor to vary a compression ratio. Therefore, the linear compressor is used for a variable cooling capacity control for a refrigerator, an air conditioner and the like.

FIG. 1 illustrates a circuit for driving a linear compressor according to related art.

Referring to FIG. 1, a circuit for driving a linear compressor according to related art includes a linear compressor 10A controlling a cooling capacity (endothermic heat from surroundings during evaporation for a cooling operation as a material of 1 Kg passes through an evaporator) by varying a stroke(a distance from one end to the other end of a piston) through an up-and-down rectilinear motion of a piston, an electric circuit unit 10 controlling a current applied to the linear compressor 10A by connecting a ground terminal between a current detect resistance R1 and a triac Tr1 and by shorting or disconnecting an alternating current in accordance with a switching signal of the triac Tr1, a current detection unit 20 detecting a current applied to the linear compressor 10A and outputting the detected current, a voltage detection unit 30 receiving a voltage between two ends of the linear compressor 10A to amplify differentially using a differential amplifier 30A and including a level shifter 30B carrying out a level shifting, a stroke calculation unit 40 receiving the detected current and voltage from the current and voltage detection units 20 and 30 and calculating a stroke of the linear compressor 10A, and a microcomputer 50 comparing the stroke calculated by the stroke calculation unit 50 to an initial stroke reference and then supplying the electric circuit unit 10 with a switching signal for controlling a voltage applied to the linear compressor 10A in accordance with a difference between the calculated stroke and initial stroke reference.

The voltage detection unit 30 includes a couple of OP amplifiers, in which a negative voltage terminal of the linear compressor 10A is connected to an inversion terminal (−) of the differential amplifier 30A through a precision resistor Ra1, a positive voltage terminal of the linear compressor 10A is connected to a non-inversion terminal(+) of the differential amplifier 30A through a precision resistor Ra2 and a precision resistor Ra3 of which one end is grounded, a precision resistor Ra4 is connected between an output terminal of the differential amplifier 30A and the inversion terminal(−) of the differential amplifier 30A, the output terminal of the differential amplifier 30A is connected to an inversion terminal(−) of the level shifter 30B through a precision resistor Ra5, a power voltage supply of 5 V is inputted to the level shifter 30B through a precision resistor Ra6 and a precision resistor Ra7 of which one end is grounded, and another precision resistor is connected between an output terminal and the inversion terminal(−) of the level shifter 30B.

Operation and effect of the circuit for driving the linear compressor according to the related art are explained by referring to the attached drawing as follows.

A normal AC alternating current power supply voltage of 220 V is applied to the linear compressor 10A through a current detect resistor R1, the triac Tr1, and a capacitor C. Thus, a current flows through the linear compressor 10A and a piston of the linear compressor 10A carries out a straight-line reciprocation motion by the current. The straight-line reciprocation determines a stroke as a straight-line reciprocation distance of the piston. Thus, the cooling capacity is controlled by varying the stroke.

In this case, the current detection unit 20 detects a current applied to the linear compressor 10A through the current resistor R1 and then inputs the detected current to the stroke calculation unit 40. The voltage detection unit 30, when the linear compressor 10A is driven, detects a voltage between both ends of the linear compressor 10A to input the voltage to the stroke calculation unit 40. In this case, the voltage between both ends of the linear compressor 10A is amplified by the differential amplifier 30A through two precision resistors R1 and R2. The value amplified by the differential amplifier 30A is then compared to the power supply voltage of 5 V by the level shifter 30B to be detected. Successively, the stroke calculation unit 40 receives the current and voltage detected from the linear compressor 10A to calculate the stroke, and then inputs the calculated stroke value to the microcomputer 50. The microcomputer 50 adjusts the voltage to be applied to the linear compressor 10A using a speed peak control algorithm stored previously in a memory of the microcomputer 50. Namely, the microcomputer 50 compares the stroke calculated by the stroke calculation unit 40 to the initial stroke reference. If the calculated stroke value is higher than the initial stroke reference, the microcomputer 50 outputs the switching signal turning off the triac Tr1 as an AC switching device of the electric circuit unit 10 to reduce the voltage applied to the linear compressor 10A.

On the other hand, if the calculated stroke, i.e. the present stroke, is lower than the initial stroke reference, the microcomputer 50 outputs the other switching signal turning on the triac Tr1 as an AC switching device of the electric circuit unit 10 to increase the voltage applied to the linear compressor 10A.

After all, through the two processes, the microcomputer 50 inputs the switching signal enabling to adjust the voltage applied to the linear compressor 10A to the triac Tr1 to make the present stroke follow the initial stroke reference.

Unfortunately, the circuit for driving the linear compressor according to the related art has to detect the voltage and current of the linear compressor using a plurality of the precision resistors to calculate a precise senseless stroke. Therefore, the circuit of the related art has to use the expensive precision resistors, thereby being unable to avoid increasing a product cost.

SUMMARY OF THE INVENTION

Accordingly, the present invention is directed to a circuit for driving a linear compressor that substantially obviates one or more problems due to limitations and disadvantages of the related art.

An object of the present invention is to provide a circuit for driving a linear compressor enabling to reduce its product cost by reducing the number of precision resistors and using a ground terminal in common for detecting voltage and current of a linear compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a circuit for driving a linear compressor according to the present invention includes a liner compressor controlling a cooling capacity by varying a stroke through an up-and-down straight-line motion of a piston, an electric circuit unit supplying the linear compressor with voltage and current in accordance with a switching signal of an AC switching device through a current detect resistor and the AC switching device wherein a ground terminal is connected between the current detect resistor and linear compressor, a voltage detect unit detecting the voltage applied to the linear compressor by taking the ground terminal as a reference and outputting the detected voltage, a stroke calculation unit receiving the detected current and voltage to calculate the stroke, a speed or an acceleration speed of the linear compressor, and a microcomputer inputting a switching signal for controlling the voltage applied to the linear compressor into the switching device to make a present stroke follow an initial stroke reference.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
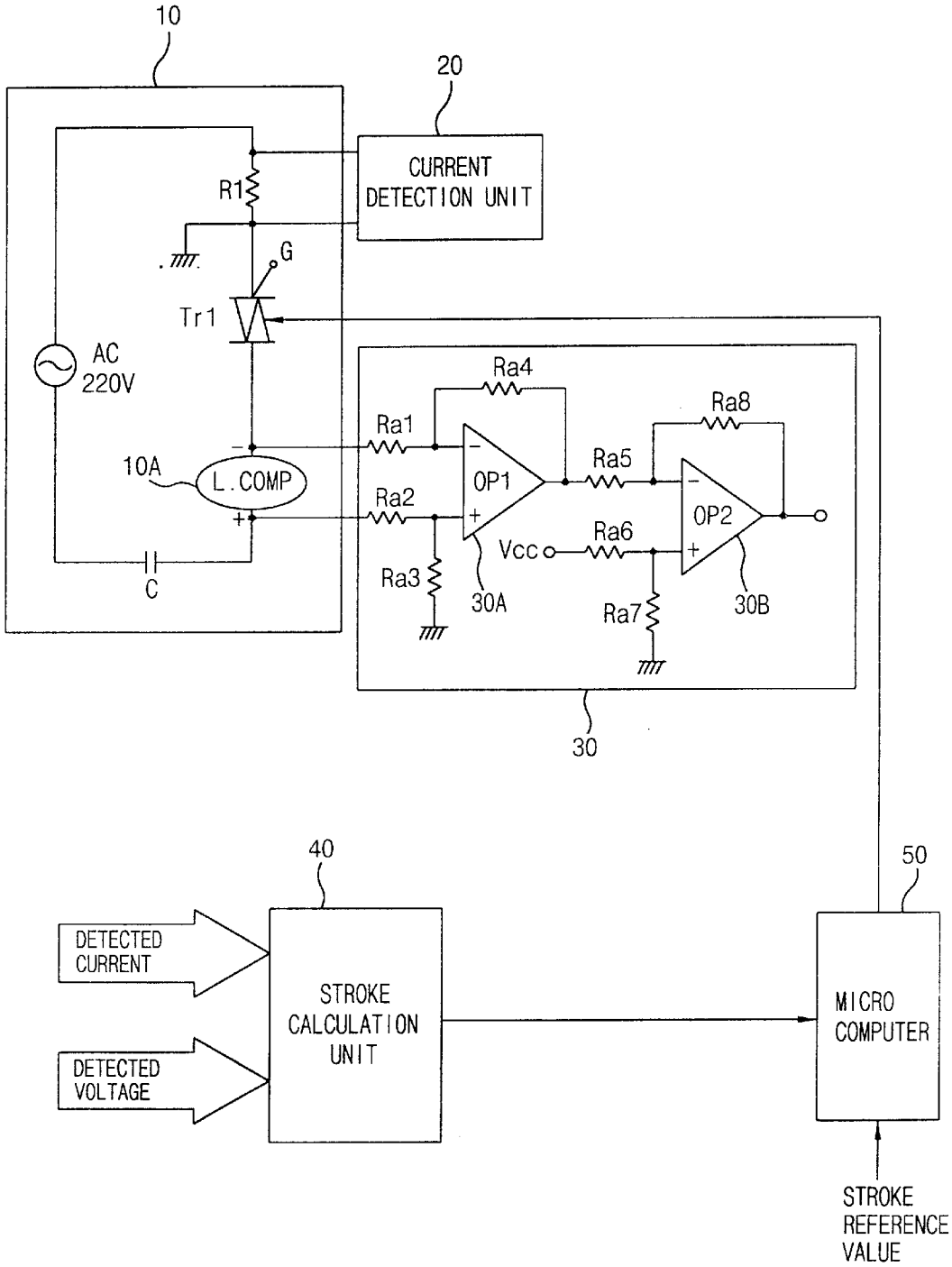
FIG. 1 CONVENTIONAL ART
FIG. 1 illustrates a circuit for driving a linear compressor according to a related art.
Figure 2:
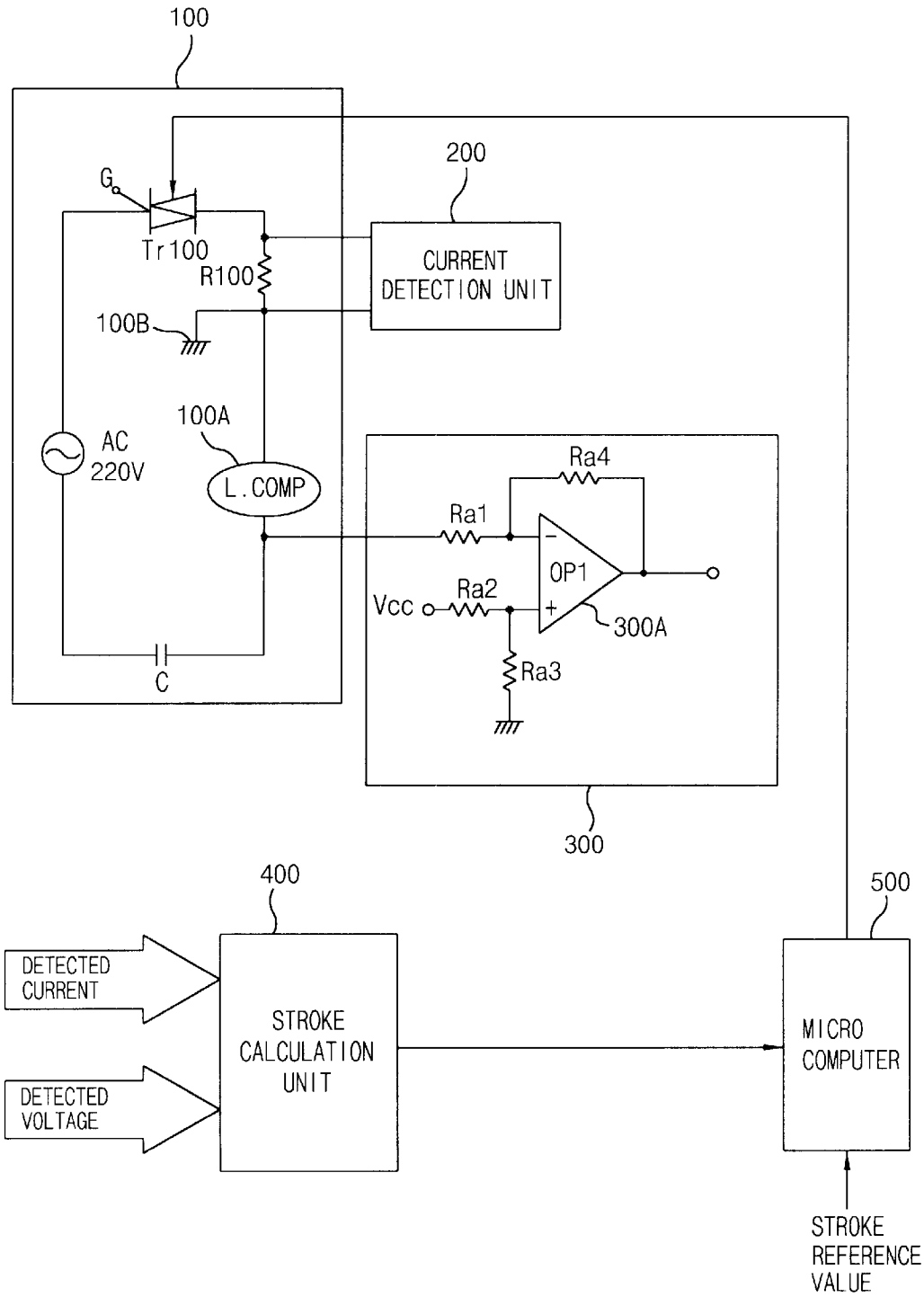
FIG. 2 illustrates a circuit for driving a linear compressor according to the present invention.

FIG. 2 illustrates a circuit for driving a linear compressor according to the present invention.

Referring to FIG. 2, a circuit for driving a linear compressor includes a linear compressor 100A controlling a cooling capacity by varying a stroke through an up-and-down straight-line motion of a piston, an electric circuit unit 100 supplying the linear compressor 100A with voltage and current in accordance with a switching signal of a triac Tr100 through a current detect resistor R100, the triac Tr100 as an AC switching device, and a capacitor C wherein a ground terminal 100B is connected between the current detect resistor R100 and linear compressor 100A, a voltage detection unit 300 detecting the voltage applied to the linear compressor 100A by taking the ground terminal 100B as a reference and carrying out a level shifting on the detected voltage to output, a stroke calculation unit 400 receiving the detected current and voltage to calculate the stroke, and a microcomputer 500 inputting a switching signal for controlling the voltage applied to the linear compressor 100A into the switching device to make a present stroke follow an initial stroke reference.

The voltage detection unit 300 includes one OP amplifier, in which the voltage of the linear compressor 100A is connected to an inversion terminal(−) of the level shifter 300A through a precision resistor Ra1, a power supply voltage of 5 V is connected to a non-inversion terminal(=) of the level shifter 300A through a precision resistor Ra2 and a precision resistor Ra3 of which one end is connected to a ground, and a precision resistor Ra4 is connected between an output terminal and inversion terminal(−) of the level shifter 300A.

Operation and effect of the circuit for driving the linear compressor according to the present invention are explained by referring to the attached drawing as follows.

A normal alternating current power supply voltage of 220 V is applied to the linear compressor 100A through a current detect resistor R100, the triac Tr100, and a capacitor C of the electric circuit unit 100. Thus, a current flows through the linear compressor 100A and a piston of the linear compressor 100A carries out a straight-line reciprocation motion by the current. The straight-line reciprocation determines a stroke as a straight-line reciprocation distance of the piston, whereby the stroke is varied. Thus, the cooling capacity is controlled by varying the stroke. In this case, the current detection unit 200 detects a current applied to the linear compressor 100A through the current resistor R100 and then inputs the detected current to the stroke calculation unit 400.

The voltage detection unit 300, when the linear compressor 100A is driven, detects a voltage between both ends of the linear compressor 100A by taking the ground terminal 100B as a reference to input the detected voltage to the stroke calculation unit 400. Namely, the voltage detection unit 300 applies the detected voltage to the inversion terminal(−) of the level shifter 300A through the precision resistor Ra1, compares the detected voltage applied to the inversion terminal(−) of the level shifter 300A to the voltage (i.e. an applied voltage after the power supply voltage of 5 V has been distributed by the precision resistors Ra2 and Ra3) applied to the non-inversion terminal(+) of the level shifter 300A, and outputs a voltage of the linear compressor 100A in accordance with the comparison.

Successively, the stroke calculation unit 400 receives the current and voltage detected by the current and voltage detection units 200 and 300 from the linear compressor 100A to calculate the stroke, and then inputs the calculated stroke value to the microcomputer 500. In this case, the microcomputer 500 adjusts the voltage to be applied to the linear compressor 100A using a speed peak control algorithm stored previously in a memory of the microcomputer 500. Namely, the microcomputer 500 compares a present stroke calculated by the stroke calculation unit 400 to the initial stroke reference. If the present stroke value is higher than the initial stroke reference, the microcomputer 500 outputs the switching signal turning off the triac Tr100 to reduce the voltage applied to the linear compressor 100A. Thus, the triac Tr100 is turned off and the voltage applied to the linear compressor 100A is reduced.

On the other hand, if the present is lower than the initial stroke reference, the microcomputer 500 outputs the other switching signal turning on the triac Tr100 of the electric circuit unit 100 to increase the voltage applied to the linear compressor 100A. Therefore, the triac Tr100 is turned on and the voltage applied to the linear compressor 100A is increased. In this case, the triac Tr100 is a device playing a role as an AC switch such as a thyristor, IGET, GTO or the like.

After all, the microcomputer 500 controls the stroke by adjusting the voltage applied to the linear compressor 100A to make the present stroke follow the initial stroke reference.

Accordingly, the present invention enables to reduce its product cost by reducing the number of precision resistors of an operational amplifier and using a ground terminal in common for detecting voltage and current applied to a linear compressor.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A circuit for driving a linear compressor, comprising:

a linear compressor controlling a cooling capacity by varying a stroke through an up-and-down straight-line motion of a piston;

an electric circuit unit supplying the linear compressor with voltage and current in accordance with a switching signal of an AC switching device through a current detect-resistor and the AC switching device wherein a first ground terminal is connected between the current detect resistor and linear compressor;

a voltage detection unit detecting the voltage applied to the linear compressor by taking the first ground terminal of the current detect resistor and the linear compressor as a reference and outputting the detected voltage;

a stroke calculation unit receiving the detected current and voltage to calculate the stroke, a speed or an acceleration speed of the linear compressor; and a microcomputer inputting a switching signal for controlling the voltage applied to the linear compressor into the switching device to make a present stroke follow an initial stroke reference.

2. The circuit of claim 1, wherein the voltage detection unit includes one OP amplifier, in which the voltage of the linear compressor is connected to an inversion terminal (−) of the level shifter through a first resistor, a power supply voltage of Vcc is connected to a non-inversion terminal(+) of the level shifter through a second resistor and a third resistor of which one end is connected to a second ground, and a fourth resistor is connected between an output terminal and the inversion terminal(−) of the level shifter.

3. The circuit of claim 1, wherein the AC switching device is one of thyristor, IGBT(insulated gate bipolar transistor), and GTO(gate turn-off)-thyristor.

4. A circuit for driving a linear compressor, comprising:

an electric circuit unit supplying the linear compressor with voltage and current in accordance with a switching signal of an AC switching device through a current detect resistor and the AC switching device, wherein a first ground terminal is connected between the current detect resistor and linear compressor;

a voltage detection unit detecting the voltage applied to the linear compressor by taking the first ground terminal as a reference and outputting the detected voltage, wherein the voltage detection unit comprises an OP amplifier, in which the voltage of the linear compressor is connected to an inversion terminal (−) of the level shifter through a first resistor, a power supply voltage of Vcc is connected to a non-inversion terminal (+) of the level shifter through a second resistor and a third resistor of which one end is connected to a second ground, and a fourth resistor is connected between an output terminal and the inversion terminal (−) of the level shifter;

a stroke calculation unit receiving the detected current and voltage to calculate the stroke, a speed or an acceleration speed of the linear compressor; and a microcomputer inputting a switching signal for controlling the voltage applied to the linear compressor 100A into the switching device to make a present stroke follow an initial stroke reference.

5. A circuit for driving a linear compressor, comprising:

a rectifier having a first node for coupling to a power source and a second node;

a first resistor having a first node and a second node, wherein the first node of the resistor is coupled to the second node of the rectifier, and the second node of the resistor is configured for coupling to the linear compressor; and a current detection unit coupled to the first and second nodes of the resistor.

6. The circuit of claim 5, wherein the rectifier comprises a triac.

7. The circuit of claim 5, wherein the second node of the resistor is also configured for coupling to a first ground terminal.

8. The circuit of claim 5, further comprising an operational amplifier having first and second inputs, wherein the first input is coupled to the linear compressor, and wherein the second input is not coupled to the linear compressor and is configured to receive a prescribed voltage.

9. The circuit of claim 8, further comprising a second resistor between the linear compressor and the operational amplifier.

10. The circuit of claim 9, further comprising a third resistor having a first node coupled to an output of the operational amplifier and a second node coupled to the first input of the operational amplifier.

11. The circuit of claim 10, further comprising a fourth resistor having a first node coupled to a voltage source and a second node coupled to the second input of the operational amplifier.

12. The circuit of claim 11 further comprising a fifth resistor having a first node coupled to the second node of the fourth resistor and a second node configured for coupling to a second ground terminal.

13. The circuit of claim 8, further comprising a stroke calculation unit configured to receive outputs of the current detection unit and the operational amplifier.

14. The circuit of claim 13, further comprising a computer configured to receive an output of the stroke calculation unit, and to apply a signal to the rectifier based on the output of the stroke calculation unit and a stroke reference value.

15. The circuit of claim 8, further comprising a capacitor having a first node coupled to the linear compressor, and a second node configured for coupling to the power source.

16. A voltage detection unit for detecting a voltage applied to a linear compressor, comprising:

an operational amplifier having first and second inputs, wherein the first input is coupled to the linear compressor, and wherein the second input is not coupled to the linear compressor and is configured to receive a prescribed voltage.

17. The voltage detection unit of claim 16, further comprising a first resistor between the linear compressor and the operational amplifier.

18. The circuit of claim 17, further comprising a second resistor having a first node coupled to an output of the operational amplifier and a second node coupled to the first input of the operational amplifier.

19. The circuit of claim 18, further comprising a third resistor having a first node coupled to a voltage source and a second node coupled to the second input of the operational amplifier.

20. The circuit of claim 19 further comprising a fourth resistor having a first node coupled to the second node of the second resistor and a second node configured for coupling to a ground terminal.

21. The circuit of claim 17, further comprising:

a rectifier having a first node for coupling to a power source and a second node;

a second resistor having a first node and a second node, wherein the first node of the second resistor is coupled to the second node of the rectifier, and the second node of the second resistor is configured for coupling to the linear compressor;

a current detection unit coupled to the first and second nodes of the second resistor; and a capacitor having a first node coupled to the linear compressor, and a second node configured for coupling to the power source.

* * * * *